US011229267B2

(12) United States Patent
Van Der Laan

(10) Patent No.: US 11,229,267 B2
(45) Date of Patent: Jan. 25, 2022

(54) KEY HOLDER

(71) Applicant: Ape B.V., Amsterdam (NL)

(72) Inventor: Lennert Van Der Laan, Amsterdam (NL)

(73) Assignee: Ape B.V., Amsterdam (NL)

( * ) Notice: Subject to any disclaimer, the term of this patent is extended or adjusted under 35 U.S.C. 154(b) by 392 days.

(21) Appl. No.: 16/360,957

(22) Filed: Mar. 21, 2019

(65) Prior Publication Data

US 2019/0289973 A1 Sep. 26, 2019

(30) Foreign Application Priority Data

Mar. 23, 2018 (NL) ..... 2020648

(51) Int. Cl.
*A45C 11/32* (2006.01)

(52) U.S. Cl.
CPC ..... *A45C 11/324* (2013.01)

(58) Field of Classification Search
CPC ..... A45C 11/324
USPC ..... 70/456 B, 456 R; 206/38.1, 37.1, 37.8
See application file for complete search history.

(56) References Cited

U.S. PATENT DOCUMENTS 548,065 A 10/1895 Keyes
1,779,621 A 10/1930 Moore
1,943,844 A 1/1934 Slotnick
2,473,758 A 6/1949 Maitlen
2,593,030 A * 4/1952 Ragnar ..... A45C 11/324 70/456 R
2,627,743 A * 2/1953 Ribbing ..... A45C 11/324 70/456 R
3,618,346 A * 11/1971 Humphrey ..... A45C 11/324 70/408
3,765,201 A * 10/1973 Humphrey ..... A45C 11/324 70/456 R
3,832,874 A * 9/1974 Willis ..... A45C 11/324 70/456 R
4,660,397 A * 4/1987 Girimont, V ..... A45C 11/321 70/456 B
5,720,211 A 4/1998 Cahan
2006/0086163 A1* 4/2006 Downes ..... A45C 11/324 70/456 R
2009/0241622 A1* 10/2009 Luo ..... A45C 11/321 70/456 B
2011/0016937 A1* 1/2011 Downes ..... A45C 11/328 70/393
2011/0073498 A1* 3/2011 Palmer ..... A45C 11/324 206/38

(Continued)

FOREIGN PATENT DOCUMENTS

GB 461719 A 2/1937
GB 508859 A 7/1939

*Primary Examiner* — Jacob K Ackun
(74) *Attorney, Agent, or Firm* — Shewchuk IP Services, LLC; Jeffrey D. Shewchuk

(57) ABSTRACT

A key holder for holding a key comprising an eye, wherein said key holder comprises a pin. A key holder that is easy to operate and can be provided with keys easily comprises
- a frame which comprises
- a space for receiving the distal end of a key, and
- arm members.

The pin is capable of being
- in a first state spanning between the arm members for retaining a key using the pin, and
- in a second state not spanning between the arm members for allowing attachment of a key.

7 Claims, 7 Drawing Sheets

(56) References Cited

U.S. PATENT DOCUMENTS

| | | | | |
|---|---|---|---|---|
| 2011/0073499 | A1* | 3/2011 | Palmer | A45C 11/324 206/38 |
| 2011/0073509 | A1* | 3/2011 | Palmer | A45C 11/324 206/372 |
| 2017/0055662 | A1* | 3/2017 | Taylor | A45D 24/10 |

* cited by examiner

KEY HOLDER

BACKGROUND OF THE INVENTION

The present invention relates to a key holder for holding a key comprising an eye, wherein said key holder comprises a pin.

A variety of key holders is known in the art. The main purpose of a key holder is to keep a multitude of keys together. Key holders may serve a variety of further purposes, such as preventing damage by the keys such as scratching of other surfaces (for example the screen of a mobile phone that may be present in the same pocket as the keys). Some key holders are suitable for one-hand operation, while others need two hands to make the desired key available for use.

A commercially available key holder is Keysmart™, where two stacks of keys and interposed rubber rings are clamped between two elongate plates using two pairs of mating screws as pins passing through the eyes of the keys. The keys are folded out like the blades of a Swiss army knife.

SUMMARY OF THE INVENTION

The object of the present invention is to provide an alternative key holder.

To this end, a key holder according to the preamble is characterized in that the key holder comprises a frame, said frame comprising
- a frame body, said frame body
  - defining a space for receiving the distal end of a key to be held by the key holder, and
  - a side opening for allowing the distal end of a key access to the space;
- a first arm member, said first arm member comprising a first proximal arm section and a first distal arm section, and
- a second arm member, said second arm member comprising a second proximal arm section and a second distal arm section, wherein said arm members extend from said frame body; and the pin, said pin being capable of being
- in a first state spanning from the first distal arm section of the first arm member to the second distal arm section of the second arm member for retaining a key using the pin, and
- in a second state not spanning from the first distal arm section of the first arm member to the second distal arm section of the second arm member for allowing attachment of a key.

Thus a key holder is provided that is easy to operate. It is also easy to provide the key holder with one or more keys or to remove one or more keys attached previously. The distal end of the at least one key attached to a key holder according to the invention can be stored in the space of the frame body when not needed. For use, keys attached to the key holder may be rotated round the pin, and the desired key is selected by returning any other keys back to the space of the frame body. The selected key is used and after use returned to the space by rotating it about the pin. Because the key holder allows rotation of one or more keys held by the key holder around the pin with relatively little friction because the key(s) are not clamped against each other/the key holder, thus not being clamped such that friction holds them in a particular orientation, the key holder can be easily operated with one hand.

According to a favourable embodiment, the pin comprises a threaded section and the second distal arm section of the second arm member comprises a complementary threaded hole.

This allows the pin to be secured to the frame in a convenient manner.

According to a favourable embodiment, the pin comprises a smooth shank and the first distal arm section of the first arm member allows passage of said smooth shank, with in the first state the smooth shank being located between the threaded section of the pin and the first arm member.

This allows a large access opening for the distal end of the key to be created easily, once the threaded section has been rotated out of the threaded hole of the second distal arm section of the second arm member. Similarly, the access opening can be closed quickly, which is quite convenient in a situation with multiple keys skewered on the pin while changing the number of keys on the key holder.

According to a favourable embodiment, the first distal arm section of the first arm member comprises a further threaded hole, said further threaded hole having a diameter of at least the diameter of the threaded hole of the second arm member.

This allows for further functionality.

According to a favourable embodiment, the further threaded hole of the first distal arm section of the first arm member has the same diameter and thread pitch as the threaded hole of the second arm member.

This prevents the pin from easily leaving the frame, avoiding the dropping or even loss of the pin. Also, less dexterity is required to change the number of keys on the key holder.

According to a favourable embodiment, the pin comprises a further threaded section capable of engaging the further threaded hole of the first arm member when the threaded section of the pin engages the threaded hole of the second arm member.

This allows for a more sturdy connection of the arm members, resulting in a more sturdy key holder for a given material and/or for given dimensions of the arm members.

According to a favourable embodiment, the frame comprises a lid hingedly connected to the frame body, the lid being capable of being in a closed first position where the frame body and the lid define the space for the keys and the lid blocks the access opening of the space and in an open second position where the space for the keys is unblocked.

Thus the keys are even less likely to cause damage because of sharp points or their beards.

According to a favourable embodiment, the lid is a spring-loaded lid, and the frame comprises a catch for maintaining the spring-loaded lid in the closed first position.

The catch can be operated manually to release the lid and making the keys available.

According to a favourable embodiment, the key holder comprises a second catch capable of holding the lid in the closed first position independent of the catch.

Thus the likelihood that the spring-loaded lid is activated due to pressure exerted in a pocket by movement of the user carrying the key holder in the pocket is reduced.

According to a favourable embodiment, the frame is provided with a pad of resilient material in the space at a side of the frame opposite of the access opening.

Thus the lid can press the keys against the pad and keys held by the key holder will be less likely to jingle yet are free to rotate about the pin when the lid of the key holder is open. The material is for example a foam.

BRIEF DESCRIPTION OF THE DRAWINGS

The present invention will now be illustrated with reference to the drawing where.

DETAILED DESCRIPTION OF THE PREFERRED EMBODIMENT(S)

Figure 1A:
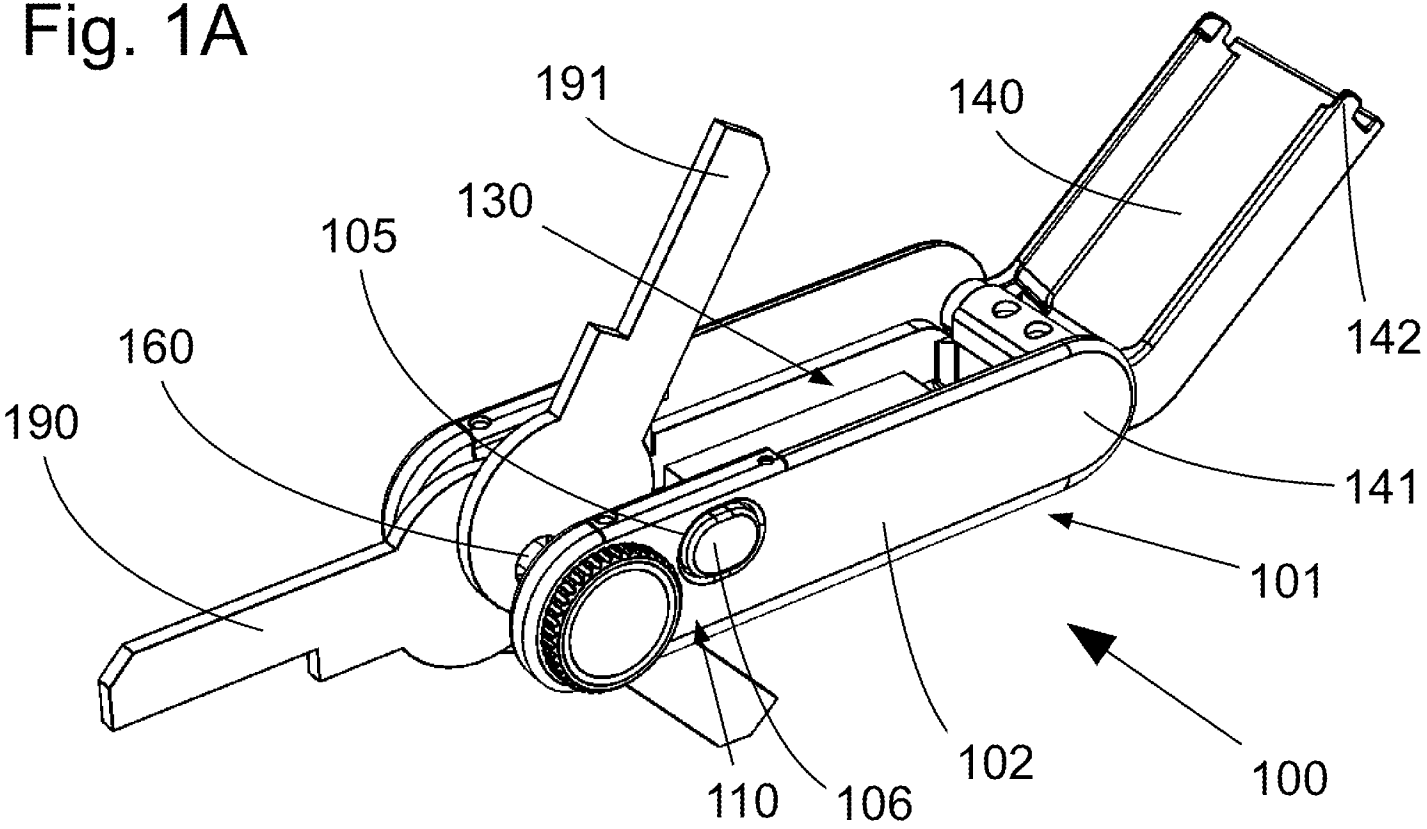
FIG. 1A to FIG. 1C show perspective views of a key holder comprising keys in three states.
Figure 1B:
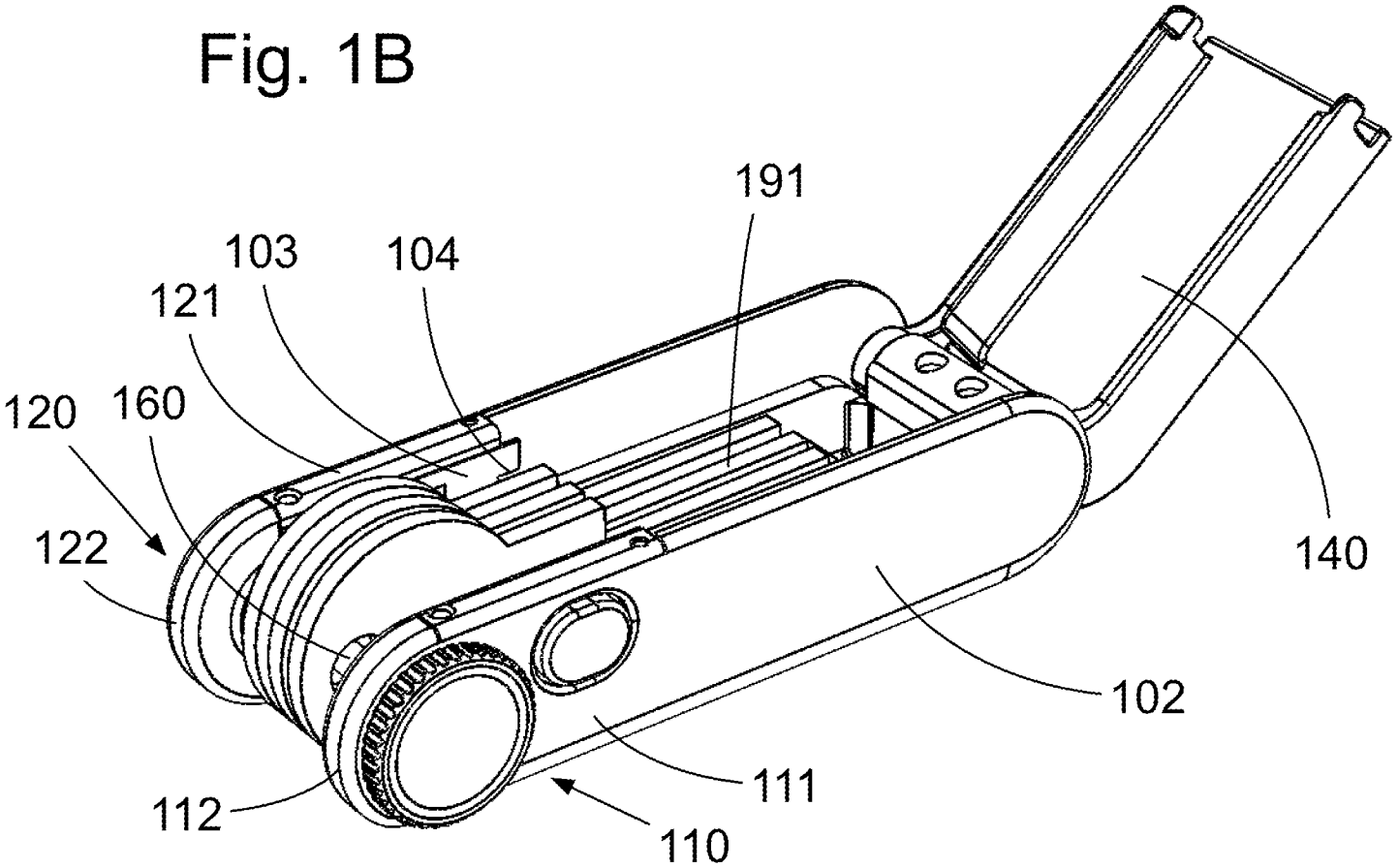
Figure 1C:
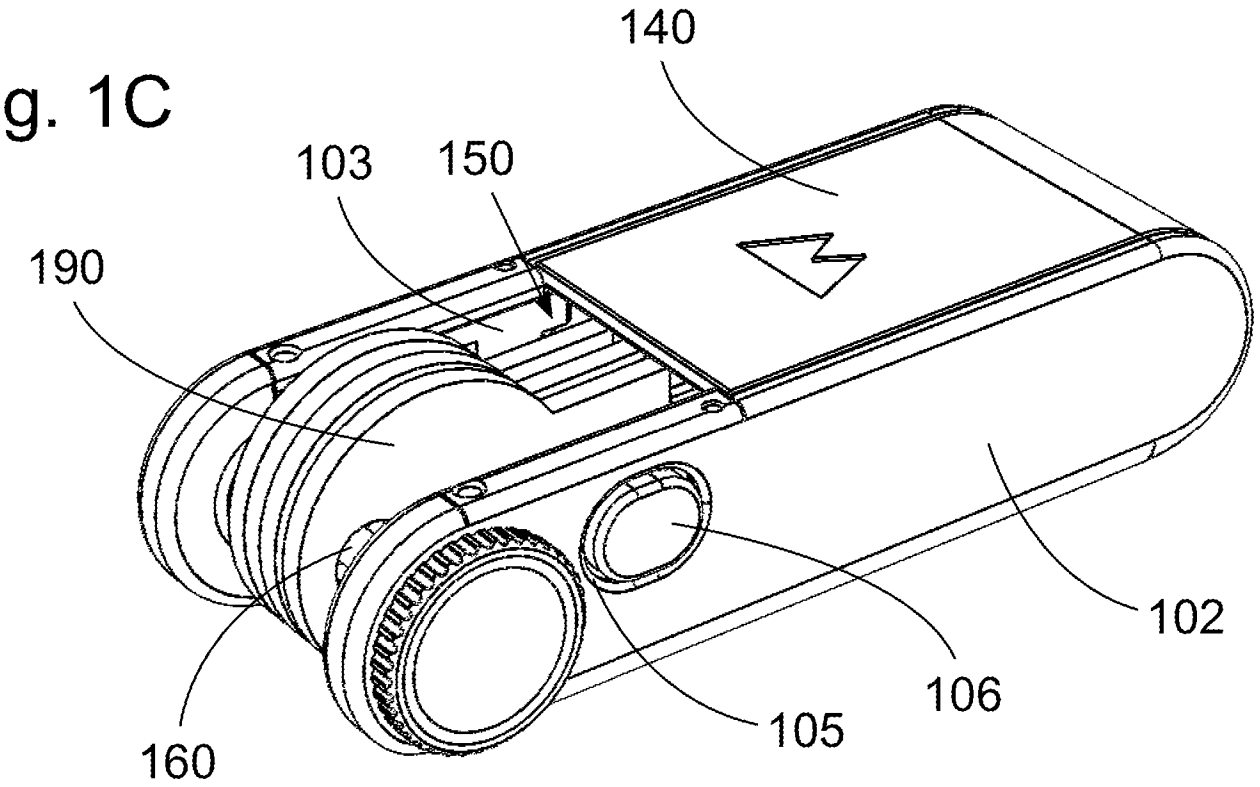

FIG. 1A to FIG. 1C show perspective views of a key holder 100 comprising keys 190 in three states, open with keys 190 out, open with keys 190 in, and closed with keys 190 in.

The key holder 100 comprises a frame 101 and a pin 160.

The frame 101 comprises a frame body 102, a lid 140, a first arm member 110 and a second arm member 120, which arm members extend from the frame body 102. The first arm member 110 has a first proximal arm section 111 and a first distal arm section 112. The second arm member 120 has a second proximal arm section 121 and a second distal arm section 122. The pin 160 extends from the first distal arm section 112 to the second distal arm section 122.

The frame body 102 defines a space 130 for receiving the distal end 191 of a key 190 held by the key holder 100, and a side opening 131 for allowing the distal end 191 of a key 190 access to the space 130 if the lid 140 is open (FIG. 1A) and the lid 140 prevents the distal ends of the keys 190 from leaving the space 130 if the lid 140 is closed.

The pin 160 passes through an eye 192 (in a proximal end) of the key 190 so as to hold said key 190.

The lid 140 pivots about an axis 141 at a side of the frame body 102 away from the arm members. The lid 140 is held close using two catches 150 that work independent of each other. To this end, the frame body 102 is provided with two resilient lever arms 103 attached to the distal arm sections and pointing towards the space 130. The lever arms 103 comprise a cut-out 104 at a side facing away from the opening 131. The cut-outs 104 catch a protrusion 142 of the lid 140 pointing away from the axis 141. The protrusion 142 has a bevelled distal end 143 (FIG. 2C) capable of pushing a lever arm 103 towards the centreline of the frame body 102 when the lid is closed. As soon as the protrusion 142 passes the distal end of the lever arm 103, said lever arm 103 snaps back and the protrusion is held in the cut-out 104 (FIG. 1C).

To open the lid 140 and allow the keys 190 to leave the space 130, the frame body 102 comprises openings 105 and the lever arms 103 comprise a knob 106 protruding into said openings 105. A user can pinch the knobs 106, as a result of which the lever arms 103 will move towards the centreline of the frame body 102 allowing the protrusions 142 of the lid 140 to pass the lever arms 103 and the lid 140 can be opened.

Figure 2A:
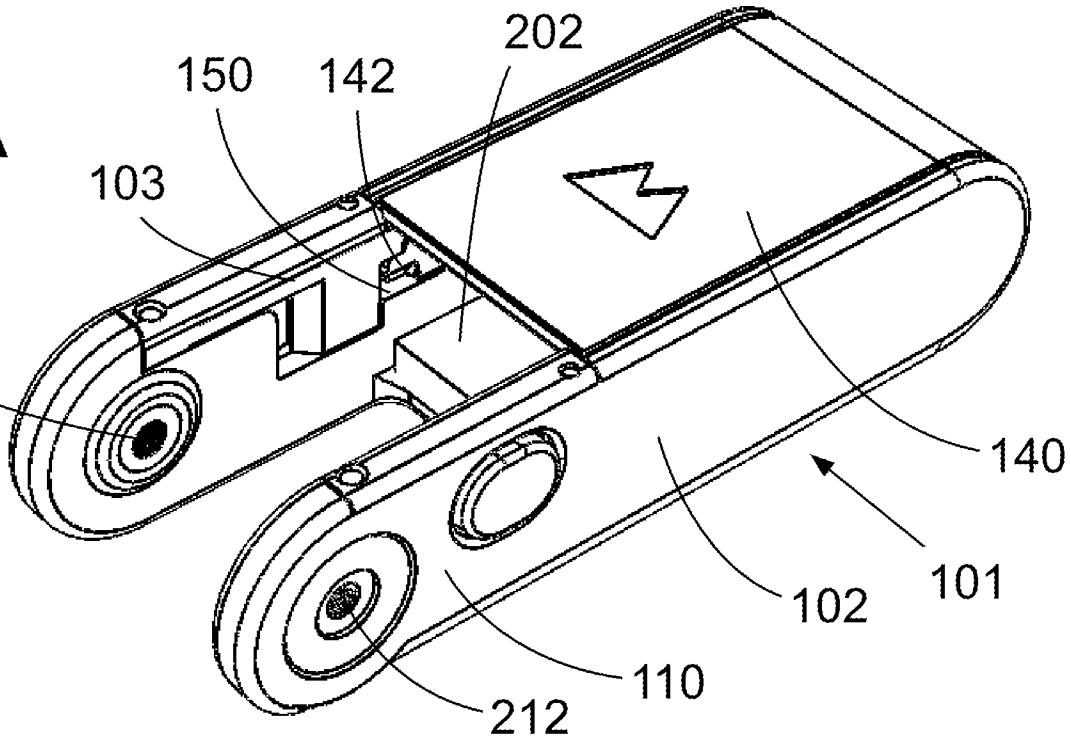
FIG. 2A shows a perspective view of the frame of the key holder of FIG. 1C.

FIG. 2A shows a perspective view of the frame 101 of the key holder 100 of FIG. 1C. A flat side of a protrusion 142, which side is parallel with and faces the opening 131 of the space 130, is held by the cut-out 104.

The first distal arm section 112 comprises a first threaded hole 212 and the second distal arm section 122 comprises a second threaded hole 222. In the embodiment discussed here, the threaded holes have the same diameter. In the claims, the first threaded hole 212 is referred to as further threaded hole.

Figure 2B:
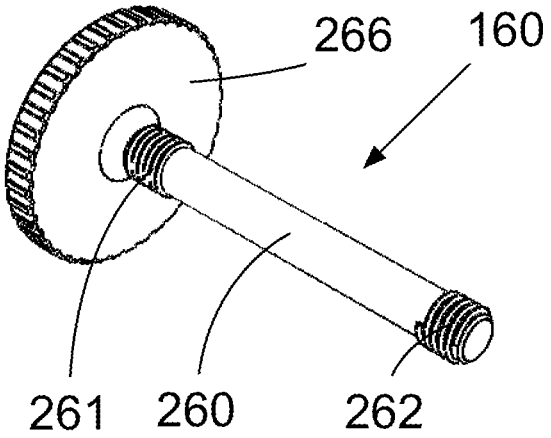
FIG. 2B shows a perspective view of a pin for the frame of the key holder of FIG. 2A.

FIG. 2B shows a perspective view of a pin 160 for the frame of the key holder of FIG. 2A. Pin 160 comprises at one end thereof a knob 266 for rotating the pin 160 by hand. The pin 160 comprises a smooth shank 260, a first threaded section 261 complementary to the first threaded hole 212 of the first arm member 110 and a second threaded section 262 complementary to the second threaded hole 222 of the second arm member 120.

Figure 2C:
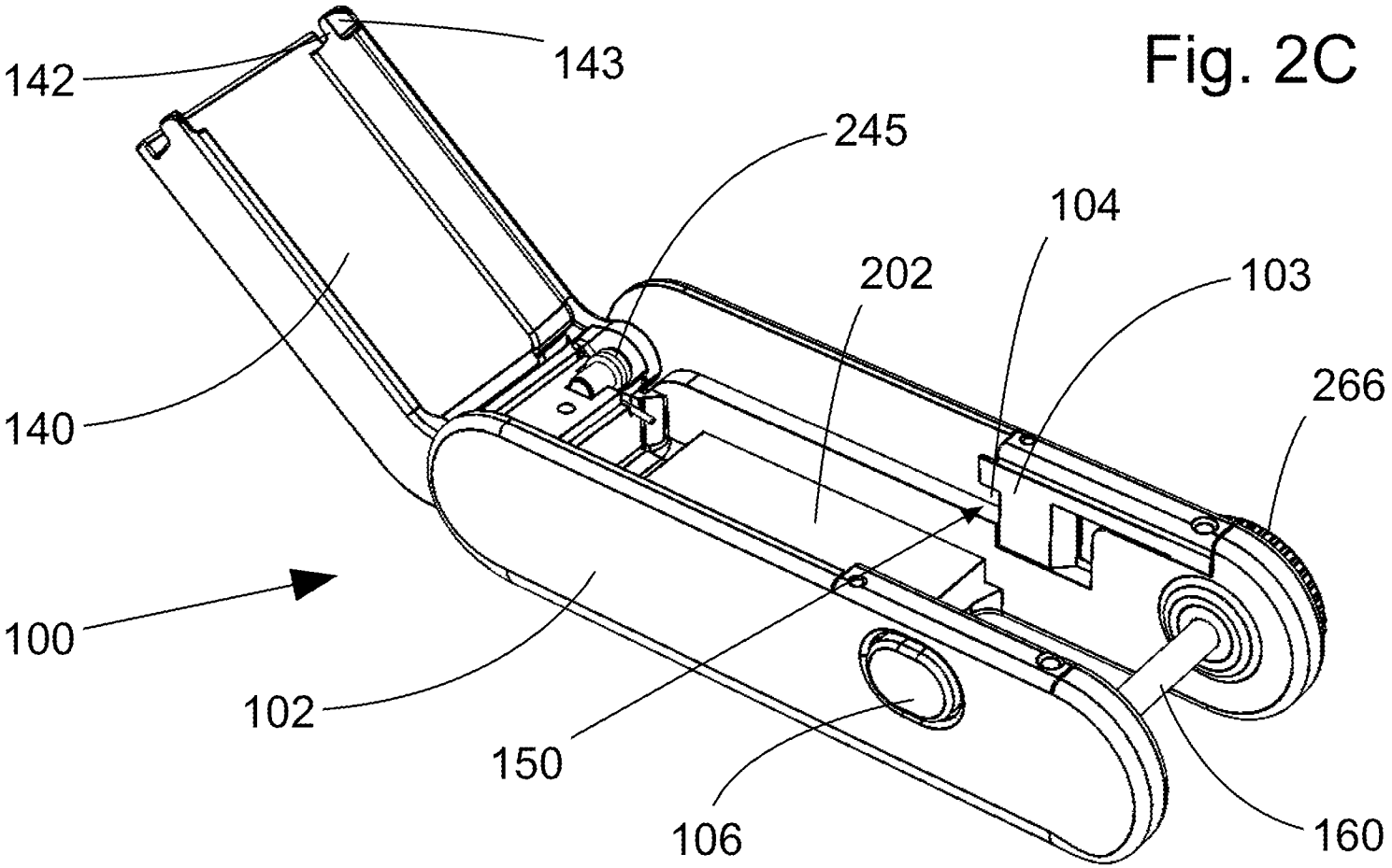
FIG. 2C shows a perspective view of a key holder comprising the frame of FIG. 2A and the pin of FIG. 2B in an assembled state.

FIG. 2C shows a perspective view of a key holder 100 comprising the frame 101 of FIG. 2A and the pin 160 of FIG. 2B in an assembled state.

A spring 245 is provided allowing the lid 140 to unblock the space 130; thus the lid 140 is a spring-loaded lid 140 allowing easy operation of the key holder 100.

At a side of the frame 101 away from the opening 131 a foam pad 202 is provided that helps to prevent the keys 190 from jingling.

Figures 3A, 3B, 3C:
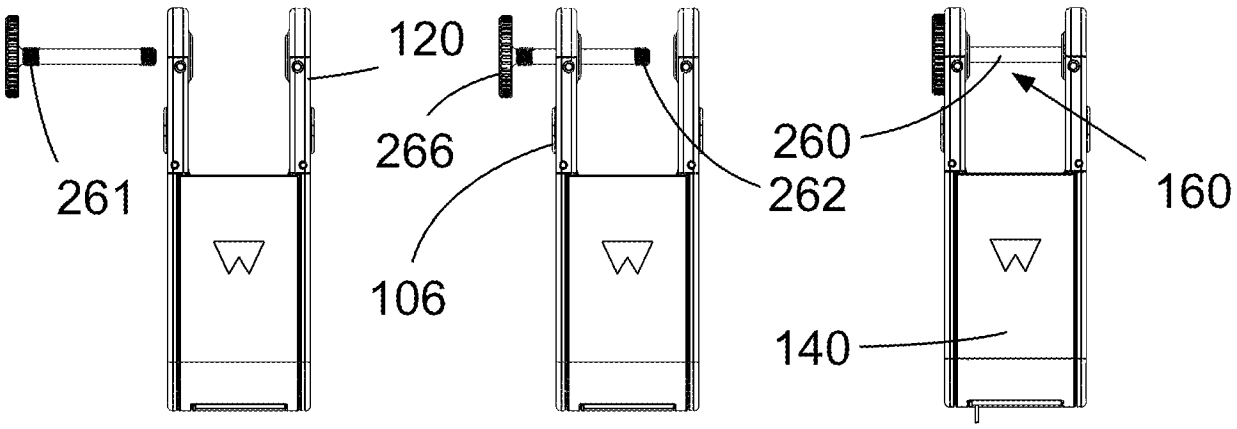
FIG. 3A to FIG. 3C show three top views of the key holder of FIG. 1A without keys with a pin in three different positions.

FIG. 3A to FIG. 3C show three top views of the key holder of FIG. 1A without keys with a pin in three different states.

In FIG. 3A a pre-assembly state of the key holder 100 of the embodiment discussed above is shown, with the second threaded section 262 of the pin 160 not yet screwed through the first threaded hole 212.

In FIG. 3B, the second threaded section 262 of the pin 160 has passed through the first threaded hole 212. The key holder 100 is in an assembled state. In the state shown in FIG. 3B, referred to as the second state in the claims, the pin 160 does not span from the first distal arm section 112 of the first arm member 110 to the second distal arm section 122 of the second arm member 120. It now allows for attachment of a key.

The pin 160 can't be dropped, because the second threaded section 262 can't pass the first threaded hole 212 without many rotations.

To retain the keys (not shown in FIG. 3), the pin 160 is brought to a state, referred to as a first state in the claims, where the pin 160 spans from the first distal arm section 112 of the first arm member 110 to the second distal arm section 122 of the second arm member 120 by screwing the second threaded section 262 into the second threaded hole 222.

The smooth shank 260 of the pin 160 allows this to be done quickly, because the pin 160 can slide over a large distance.

The invention claimed is:

1. A key holder for holding a key comprising an eye, wherein said key holder comprises a pin;

wherein the key holder comprises a frame, said frame comprising a frame body, said frame body defining a space for receiving the distal end of a key to be held by the key holder, and a side opening for allowing the distal end of a key access to the space;

a first arm member, said first arm member comprising a first proximal arm section and a first distal arm section, and a second arm member, said second arm member comprising a second proximal arm section and a second distal arm section, wherein said arm members extend from said frame body; and the pin, said pin being capable of being in a first state spanning from the first distal arm section of the first arm member to the second distal arm section of the second arm member for retaining a key using the pin, and in a second state not spanning from the first distal arm section of the first arm member to the second distal arm section of the second arm member for allowing attachment of a key;

wherein the pin comprises a threaded section and the second distal arm section of the second arm member comprises a complementary threaded hole;

wherein the first distal arm section of the first arm member comprises a further threaded hole, said further threaded hole having a diameter of at least the diameter of the threaded hole of the second arm member; and wherein the pin comprises a further threaded section capable of engaging the further threaded hole of the first arm member when the threaded section of the pin engages the threaded hole of the second arm member.

2. The key holder according to claim 1, wherein the pin comprises a smooth shank and the first distal arm section of the first arm member allows passage of said smooth shank, with in the first state the smooth shank being located between the threaded section of the pin and the first arm member.

3. The key holder according to claim 1, wherein the further threaded hole of the first distal arm section of the first arm member has the same diameter and thread pitch as the threaded hole of the second arm member.

4. The key holder according to claim 1, wherein the frame comprises a lid hingedly connected to the frame body, the lid being capable of being in a closed first position where the frame body and the lid define the space for the keys and the lid blocks the access opening of the space and in an open second position where the space for the keys is unblocked.

5. The key holder according to claim 4, wherein the lid is a spring-loaded lid, and the frame comprises a catch for maintaining the spring-loaded lid in the closed first position.

6. The key holder according to claim 5, wherein the key holder comprises a second catch capable of holding the lid in the closed first position independent of the catch.

7. The key holder according to claim 4, wherein the frame is provided with a pad of resilient material in the space at a side of the frame opposite of the access opening.

* * * * *